United States Patent [19]

Kleinschmidt

[11] Patent Number: 4,809,628

[45] Date of Patent: Mar. 7, 1989

[54] DEVICE TO STOP LUBRICANT FLOW ON A FEED DOG CARRIER OF A SEWING MACHINE

[75] Inventor: Johann O. Kleinschmidt, Karlsruhe, Fed. Rep. of Germany

[73] Assignee: Union Special, GmbH, Stuttgart, Fed. Rep. of Germany

[21] Appl. No.: 76,245

[22] Filed: Jul. 21, 1987

[30] Foreign Application Priority Data

Aug. 5, 1986 [DE] Fed. Rep. of Germany ..... 3626513

[51] Int. Cl.[4] ..... D05B 27/02; D05B 71/00

[52] U.S. Cl. ..... 112/323; 112/256

[58] Field of Search ..... 112/256, 323; 277/177

[56] References Cited

U.S. PATENT DOCUMENTS 583,414 5/1897 Muther et al. ..... 112/323

1,221,254 4/1917 Weis ..... 112/256 X 2,483,036 2/1949 Christensen ..... 112/256

4,075,960 2/1978 Klundt ..... 112/256

4,284,019 8/1981 Marchesi ..... 112/256

FOREIGN PATENT DOCUMENTS 1132781 7/1962 Fed. Rep. of Germany ..... 112/323

*Primary Examiner*—Wm. Carter Reynolds

*Attorney, Agent, or Firm*—Powell L. Sprunger

[57] ABSTRACT

A device to stop lubricant flow in a sewing machine comprising, a housing having a lubrication chamber, and a feed dog carrier having a part projecting out of the lubrication chamber, a feed dog in the area of stitch formation of the sewing machine, and a sliding surface of said part with a step. The device has a sealing element for the feed dog carrier, and a device for driving the feed dog carrier.

2 Claims, 2 Drawing Sheets

DEVICE TO STOP LUBRICANT FLOW ON A FEED DOG CARRIER OF A SEWING MACHINE

BACKGROUND OF THE INVENTION

The present invention relates to a device to stop lubricant flow on a feed dog carrier.

Lubricant sealing devices for feed dog carriers in sewing machines are known and are described, for example, in German Patent Specification No. 30 33 153 corresponding to U.S. Pat. No. 4,284,019.

As a result of the lifting and sliding movements of the feed dog carrier, such lubricant sealing devices are subjected to continuous wear, which leads to leaks in the lubricant sealing device. Even f the seals are not worn, it is not possible to completely prevent lubricant escaping from the lubrication chamber, as the sealing element and feed dog carrier in such lubricant sealing devices are only frictionally engaged. As a result, the sliding surfaces of the feed dog carrier projecting out of the lubrication chamber are also wetted with lubricant. The sliding motion of the feed dog carrier causes lubricant to enter the stitch formation zone. of the sewing machine, thus dirtying the workpiece considerably during the sewing operation.

SUMMARY OF THE INVENTION

A feature of the invention is the provision of a device to stop lubricant flow of a feed dog carrier in a sewing machine.

The device of the present invention comprises, a housing having a lubrication chamber, a feed dog carrier having a part projecting out of the lubrication chamber, a feed dog in the area of stitch formation of the sewing machine, and a sliding surface of said part. The device has a sealing element for the feed dog chamber and means for driving the feed dog carrier.

A feature of the present invention is that the projecting part of the feed dog carrier has a step.

Another feature of the invention is that the stop stops lubricant flow on the feed dog carrier to the free end of the feed dog carrier and stitch formation zone.

Yet another feature of the invention is that the lifting motion of the feed dog carrier and the earth's gravity cause the excess lubricant to be drawn off at the edge of the step on the feed dog carrier into a lubricant return chamber.

Further features will become more fully apparent in the following description of the embodiments of this invention and from the appended claim.

DESCRIPTION OF THE PREFERRED EMBODIMENTS

Figure 1:
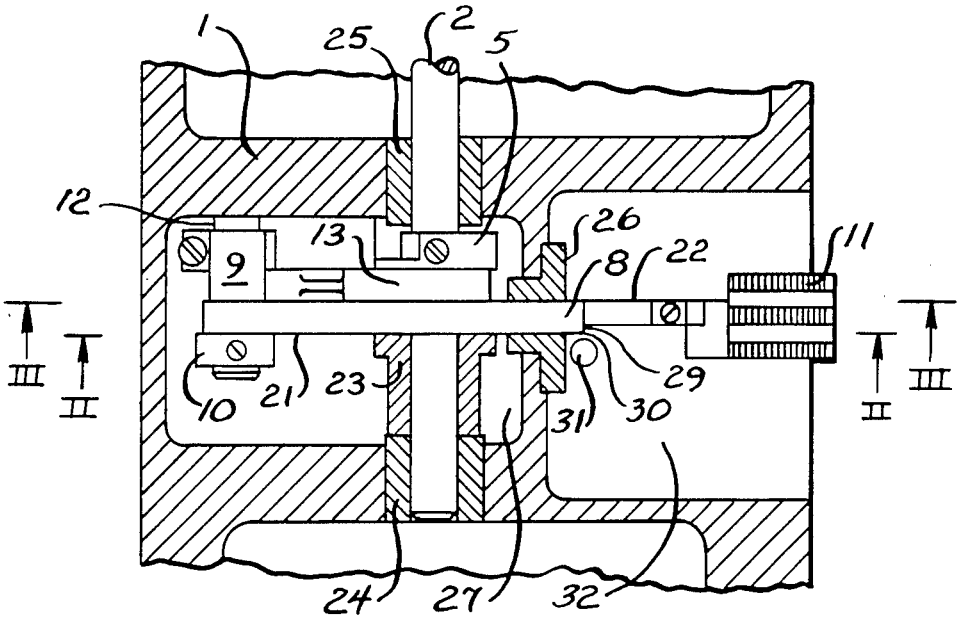
FIG. 1 is a plan view of a device to stop lubricant flow of a feed dog carrier with drive members.
Figure 2:
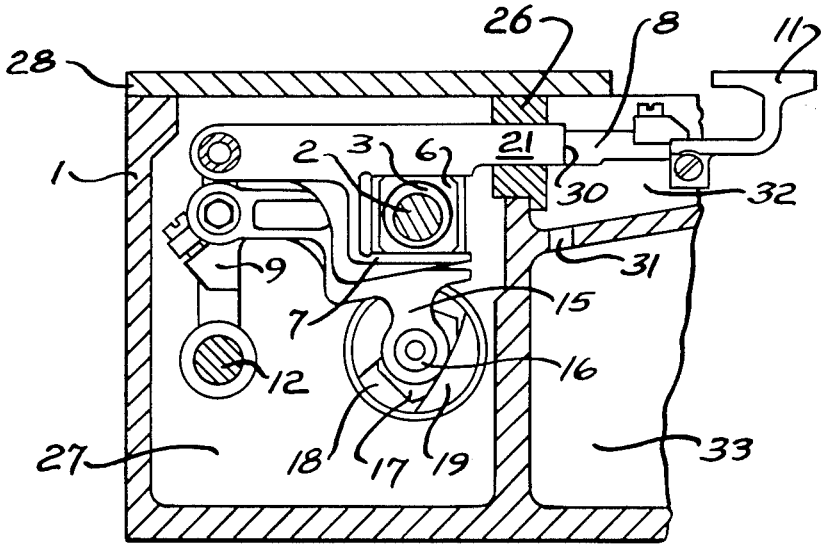
FIG. 2 is a sectional view taken substantially as indicated along the line II—II of FIG. 1.
Figure 3:
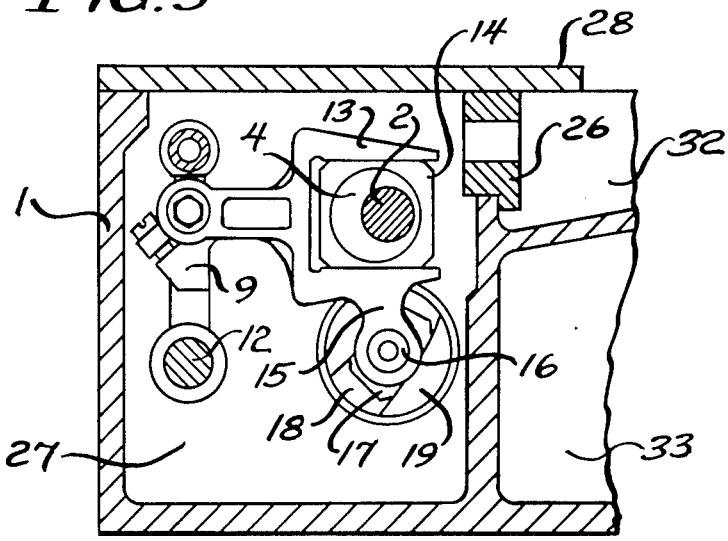
FIG. 3 is a sectional view taken substantially as indicated along the line III—III of FIG. 1.

A device to stop lubricant flow is disposed in a housing 1. A main shaft 2 carries an eccentric element, which has a lifting eccentric 3, a sliding eccentric 4, and a counterbalance disc 5. The lifting eccentric 3 is enclosed by a sliding block 6, which is mounted in a fork 7 of a feed dog carrier 8. One end of the feed dog carrier 8 is articulated to a frame 9 and fastened by an adjustable collar 10, and its free end carries a feed dog 11. The frame 9 is mounted on a shaft 12, which is fixed to the housing, and is articulated to a guide fork 13.

A sliding block 14, which surrounds the sliding eccentric 4, lies in the guide fork 13. The guide fork 13 has an arm 15 which carries a bolt 16 on which a slide block 17 is mounted. The slide block 17 is guided in a guideway 18, which is disposed in an adjustable member 19.

The feed dog carrier 8 has a sliding surface 21 and 22 on each side and is laterally guided by means of a spacer bushing 23, which is supported by a housing bushing 24. The main shaft 2 is mounted in a further housing bushing 25. A sealing element 26, which is fitted on a lubrication chamber 27, surrounds the feed dog carrier 8. The lubrication chamber 27 is closed by a cover plate 28.

The sliding surface 21 of the feed dog carrier 8 is provided with a vertical step 29 having an edge 30 in such a way that the end of the feed dog remote from the lubrication chamber narrows. A lubricant line 31 connects a lubricant return chamber 32, whose base slopes in the direction of the lubrication chamber 27, to a chamber 33.

By turning the main shaft 2, a lifting and sliding motion is transmitted to the feed dog carrier 8 by way of the drive elements in the lubrication chamber 27. The lifting motion of the feed dog carrier 8 causes the lubricant wetting the sliding surface 21 to be drained off at the edge 30 of the step 29 into the lubricant return chamber 32. The excess lubricant flows through the lubricant line 31 into the chamber 33.

The effectiveness of the device to stop lubricant flow is increased by adding a further step to the second sliding surface 22 of the feed dog carrier 8 outside the lubrication chamber 27.

The foregoing detailed description is given for clearness of understanding only, and no unnecessary limitations should be understood therefrom, as modifications will be obvious to those skilled in the art.

What is claimed is:

1. A device to stop lubricant flow in a sewing machine, comprising:

a housing having a lubrication chamber;

a feed dog carrier having a part projecting out of the lubrication chamber, a feed dog in the area of stitch formation of the sewing machine, and a sliding surface of said part with a step;

a sealing element for the feed dog carrier; and means for driving the feed dog carrier wherein the housing has a lubricant return chamber disposed in the region of the part connected to a lower chamber by a lubricant line, said lower chamber being isolated from the lubrication chamber.

2. The device of claim 1 wherein said step is disposed vertically on the feed dog carrier and narrows the end of the feed dog carrier remote from the lubrication chamber.

* * * * *